United States Patent [19]

Beggs

[11] Patent Number: 4,845,323

[45] Date of Patent: Jul. 4, 1989

[54] FLEXIBLE TACTILE SWITCH

[75] Inventor: George R. Beggs, Boulder, Colo.

[73] Assignee: Tactilitics, Inc., Colo.

[21] Appl. No.: 91,448

[22] Filed: Aug. 28, 1987

[51] Int. Cl.[4] ..... H01H 3/02

[52] U.S. Cl. ..... 200/85 R; 200/5 A; 200/86 R; 200/515 B; 340/666

[58] Field of Search ..... 361/395, 398, 399; 340/665, 666, 667, 933; 174/115; 307/119; 200/159 B, 5 R, 5 A, 85 R, 85 A, 86 R, 85 A, 61.19, 61.41, 86.5, 333

[56] References Cited

U.S. PATENT DOCUMENTS

| | | | |
|---|---|---|---|
| 3,243,540 | 3/1966 | Miller | 200/86 R |
| 3,694,600 | 9/1972 | Koenig | 200/85 A |
| 4,086,458 | 4/1978 | Dickey | 200/86 R |
| 4,497,989 | 2/1985 | Miller | 200/86 R |
| 4,565,910 | 1/1986 | Musick | 200/86 R |
| 4,617,433 | 10/1986 | Hoshikawa | 200/86 R |
| 4,623,768 | 11/1986 | Grant | 200/5 A |
| 4,700,025 | 10/1987 | Hatayama | 200/5 A |
| 4,701,579 | 10/1987 | Kurachi | 200/5 A |

*Primary Examiner*—G. P. Tolin

[57] ABSTRACT

A conformal electrical sensor switch for determining the presence or absence of weight, such as a person in a bed, comprises flexible, parallel sensing strips positioned to make contact when pressure is applied. Sensing strip circuits are held apart by a separator strip until pressure is applied and thus closing a latch which provides signal output through snap connectors which are affixed to the sensing strips and which extend beyond the sealed flexible cover of the sensor switch. The flexible cover serves to secure the sensing strips and connectors in a facing relationship. The connectors are designed to permit easy attachment to a variety of signal processing/monitoring devices.

6 Claims, 3 Drawing Sheets

FLEXIBLE TACTILE SWITCH

BACKGROUND OF THE INVENTION

1. Field of the Invention

This invention relates to new and useful improvements in apparatus for sensing the presence and movement of bed patients, and more specifically improved sensor switch apparatus for electronically sensing the presence, and the absence location of a person's weight on a bed, chair or the like and sensing a person's movements while in bed, all to assist patient care personnel in monitoring patient safety from a remote location.

2. Description of Prior Art

A common and continuous problem encountered in hospitals, nursing homes, and home care settings is that of patients getting out of bed at a time when their condition, because of medication, disorientations, dizziness, disease, age, or other reasons, is such that unassisted ambulation may create a risk to that person's safety. And, further, that a patient's movement while in bed may indicate a change in their physical condition or that such movement may jeopardize medical treatment or medical monitoring attachments to the patient. Thus it is important that patient care personnel be apprised of any attempted arising of such patients or any movements that may produce complications. This concern is particularly acute in situations of staff reductions in institutions, or in a home care setting where round-the-clock care may be a family responsibility.

Monitoring devices have been developed to address some of these concerns. Such devices are described in U.S. Pat. Nos. 4,179,692, 4,295,133, 4,484,043 and 4,565,910.

Generally, these sensing devices have employed electronic means to activate signals or alarms for the purpose of alerting care givers to the patient's attempts to arise. In order for the electronic circuitry to fulfill its function, however, a convenient and dependable sensor switch must be provided to actuate the circuitry. Such a switch must be reliable in providing signals when the patient is leaving the bed or when the patient is moving in bed, and in the case of switches placed in the bed must avoid false signals from the switch being twisted or contorted over uneven support surfaces, such as rumpled bed linens, mattresses, chair seats, and the like. There is therefore, a need for an elongated sensor switch that is economical to construct, easy to use, dependable, and adaptable to use on curved or irregular supporting and actuating surfaces.

SUMMARY OF THE INVENTION

Accordingly, a general object of the present invention is to provide a single sensor switch device that can provide output data to conventional monitoring circuitry indicative of the presence, the location, the absence, or motion of a patient.

A more specific object of the present invention is to provide a device that is self-conforming to curved or irregular supporting and activating surfaces, and does not cause discomfort or skin pressure points to the patient.

Still another specific object of the invention is to provide a sensor switch that is simple and inexpensive to manufacture and sufficiently cost effective to be disposable at the option of the user.

Yet another object of the invention is to provide a sensor switch device that can, after use with a noninfectious patient, be cleaned for re-use with another noninfectious patients at the option of the user.

A further object of this invention is to provide a sensor switch device which is detachable from its associated processing and monitoring circuitry in such a manner that facilitates cleaning, disposal, replacement, and use with a variety of signal processing and monitoring means.

Additional objects, advantages and novel features of this invention are set forth in the description that follows, and in part will become apparent to those skilled in the art upon examination of the following specification or may be learned by the practice of the invention. The objects and advantages of the invention may be realized and attained by means of the instrumentalities and in combination particularly pointed out in the appended claims.

To achieve the foregoing and other objects and in accordance with the purposes of the present invention as embodied and broadly described herein, the apparatus of this invention may include a sensor switch comprised of two elongated, thin sensing members of flexible material, such as vinyl, coated with an electrically conductive material, such as graphite-based ink, metal foil, or tape, to create electrical circuits. The electrical circuits of one of the sensing members terminate at one end member in connecting terminals which are attached to the sensing member material in such a way that the connector terminals make contact with the electrically conductive material. The connector terminals extend outside of the sensor so as to provide access and attachment points for electrical wire or cable leads from signal processing or pickup devices. The sensing strips, circuits, and a sensing strip seperator are enclosed within a flat casing of flexible material, such as polyethylene, through which the connector terminals extend. Separating the flexible sensing members is a flexible, compressible strip of electrically nonconductive material, such as polyurethane foam, of a thickness to prevent electrical contact of the sensing members when no weight is applied, and being of such thickness that when compressed by weight, the sensing members make contact, permitting the flow of electrical signals.

The apparatus can be positioned beneath a patient, more particularly between the mattress and bed sheets, mattress pads, or decubitus ulcer pads. The device need not come in contact with the patient. When the device receives the weight of the patient, the apparatus will compress, causing the conductive elements to make contact. As long as the patient remains on the sensor, a "closed" signal will occur and provide an indication of presence of the patient. When the patient leaves the bed, the normal rigidity of the compressible sensing strip separator is sufficient to cause the conductive elements to seperate from each other, providing an open circuit to indicate the absence of the patient. Further, certain "cells" of the conductive ink circuits can be activated or interrogated by the electronic control system so as to observe the location of a patient on the apparatus. In conjunction with a timer, in a remote electronic control system the apparatus may thus function to identify motion or restlessness of the patient.

BRIEF DESCRIPTION OF THE DRAWINGS

The accompanying drawings, which are incorporated in, and form a part of, the specifications illustrate the preferred embodiment of the present invention, and together with the description, serve to explain the principals of the invention. In the drawings.

DETAILED DESCRIPTION OF THE PREFERRED EMBODIMENT

Figure 1:
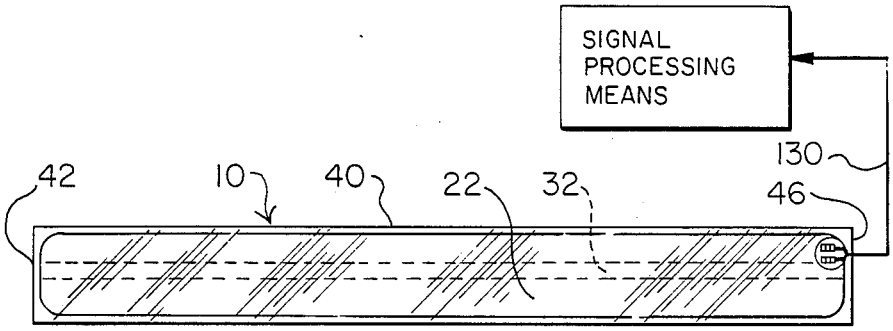
FIG. 1 is a top view of an apparatus for monitoring patient presence in a bed incorporating the principles of this invention.
Figure 3:
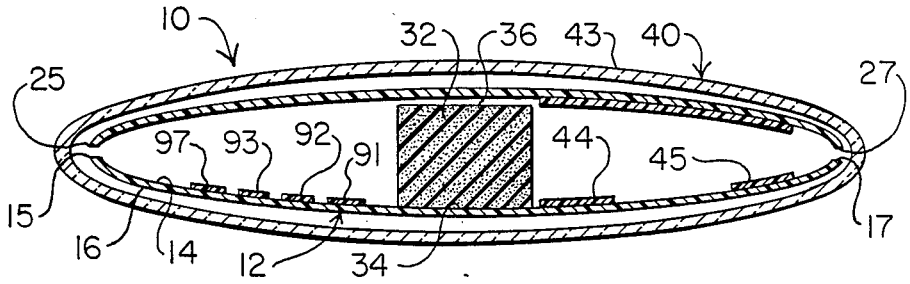
FIG. 3 is a cross-sectional view taken along the line 3—3 of FIG. 1 showing more details of the construction of the apparatus.
Figure 8:
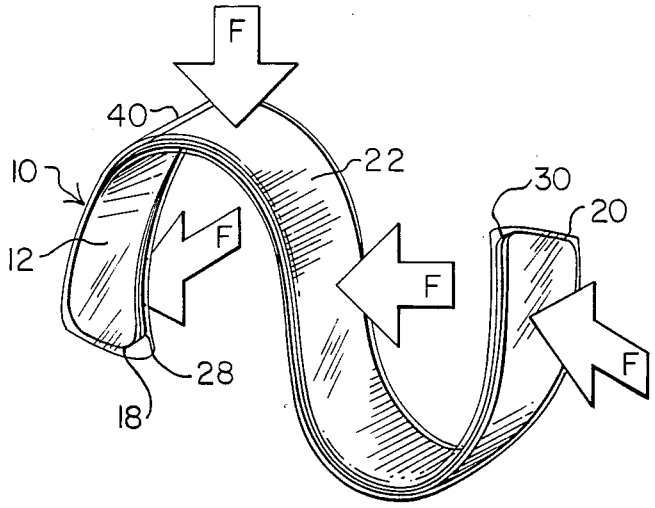
FIG. 8 is an elevation view that illustrates the assembly deformed in a complex arcuate and torqued form.

An apparatus for monitoring bed patients in hospitals, nursing homes, and home care settings is shown in FIGS. 1, 3, 8, and is indicated generally by the numeral 10. It includes a base sensing member 12 and a contact sensing member 22, both formed of non-electrically conductive flexible thin material, (for example, 10 mil vinyl). The base sensing member 12 is of generally rectangular configuration having opposed sides 14,16 and ends 18, 20 and it has sensing circuits comprising components 44, 45 preferably of silkscreened conductive ink, bonded to its inner surface 14. The width of the base member 12 may be approximately 3 inches, and its length may be approximately 32 inches.

A contact member 22 positioned in a facing relationship to base member 12 is of generally rectangular configuration having opposed sides 24, 26 and ends 28, 30 and it is of approximately the same size, thickness, and composition as the base sensing member 12. The contact member 22 has a contact circuit 43, preferably of silkscreened conductive ink, bonded to its inner surface 24 and positioned in facing relation to the circuit members 44, 45 on member 12. The contact circuit member 43 is also of sufficient width to contact both the circuit members 44, 45 at the same time. Base sensing member 12 and contact sensing member 22 mat have rounded corners if desired.

Figure 4:
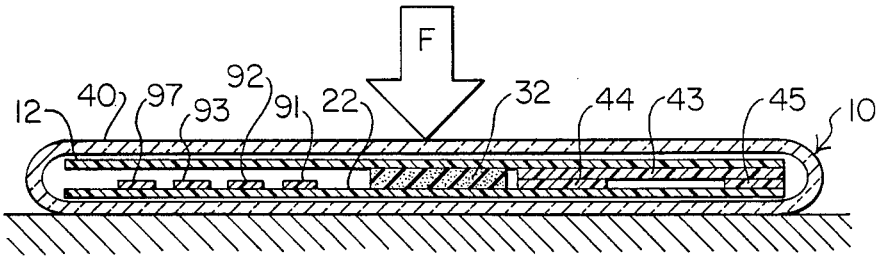
FIG. 4 is a cross-sectional view taken along line 4—4 of FIG. 1 illustrating more details of construction of the apparatus and showing that when pressure is applied to the outer surfaces, the foam member 32 is compressed and the circuits are forced into contact to perform the necessary sensing functions.
Figure 7:
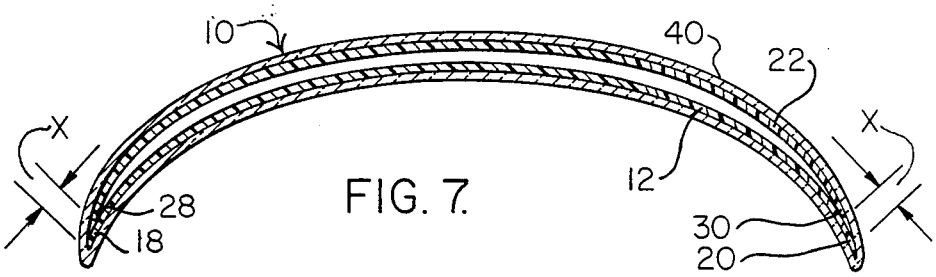
FIG. 7 is a side elevation view that illustrates the assembly deformed in a complex shape.

Affixed to the inner surface 14 of base member 12 is the first surface 34 of an elongated thin separator member 32 having a generally rectangular cross section. The second surface 36 of the separator member 32 contacts the inner surface 24 of contact member 22, but is not affixed to it. The separator strip is preferably an open-cell, low density polyurethane foam, preferably of 1 to 2 pounds per cubic foot density with dimensions which may be approximately $\frac{3}{8}$ of an inch in width by 32 inches in length by 3/16 of an inch in thickness, and serves to cause conductive surfaces 43, 44 and 45 of sensing members 12 and 22 to be supported in a spaced-apart relationship as shown by FIG. 3, until a downward force F is applied, as shown in FIG. 4. Such a downward force F of sufficient magnitude can compress the foam strip 32 to allow connecting member 43 to contact members 44, 45 to complete or close an electric circuit. The seperator strip is affixed to only one of the sensing members, in order to allow movement of the sensing members in relationship to each other when the sensor is flexed, as shown in FIG. 7.

FIG. 8 as illustrated in FIG. 3 the members 12, 22 are separate strips and the edges 15, 17 of member 12 are not connected to the edges 25, 27 of member 22. Therefore, when the apparatus 10 is put into an arcuate flexure, as shown in FIG. 7 and FIG. 8, a slight longitudinal differential movement X of the ends is possible, thus allowing a space to be maintained between members 12, 22 and preventing connector circuit member 43 from contacting circuit members 44, 45 when no force F is applied. If the edges 15, 17 were connected to respective edges 25, 27 the members 12, 22 or if ends 18, 28 were connected to respective ends 20, 30 the two sensing members 12 and 22 would be forced to occupy the same plane during flexure and thus, flexure and not said force F would cause the circuit member 43 to contact circuit members 44, 45 and give a false closed circuit signal; this type of false signaling being inherent in the inventions of Musick et al., U.S. Pat. No. 4,565,910, N. K. Miller, U.S. Pat. No. 3,243,540, N. K. Miller, U.S. Pat. No. 4,497,989, Dickey, U.S. Pat. No. 4,086,458, Koenig, U.S. Pat. No. 3,694,600 and Hatayama, U.S. Pat. No. 4,700,025.

In order for members 12 and 22 to flex and have slight longitudinal differential movement, an outside cover member 40 is positioned over the members 12, 22. The cover member 40 can be fabricated of a material such as polyethylene plastic in the form of an elongated sleeve or tube, and the members 12, 22 can be inserted together into the cover member 40. The covering member closely fits the outside surfaces 16 and 26 of the base member 12 and contact member 22. The fit of the encasing member is such as to bring the entire lengths of the edges 15, 25, 17, 27 of the sensing members 12, 22 into linear alignment with each other.

In constructing the apparatus, the base member is first provided with the dimensions as previously set out. Then, according to FIG. 5, conductive ink circuits are applied to surface 14 of member 12, in a manner to provide seperate contact cells. Circuits are applied in such a manner that they are arranged in longitudinal fashion along one side of the center line of member 12. Similarly, according to FIG. 6, contact member 22 is provided with the dimensions as previously set out and silkscreened onto it an electrically conductive circuit which is one continuous longitudinal circuit that extended from edge 25 of member 22 to approximately its center line and from end 26 to end 28.

Figure 2:
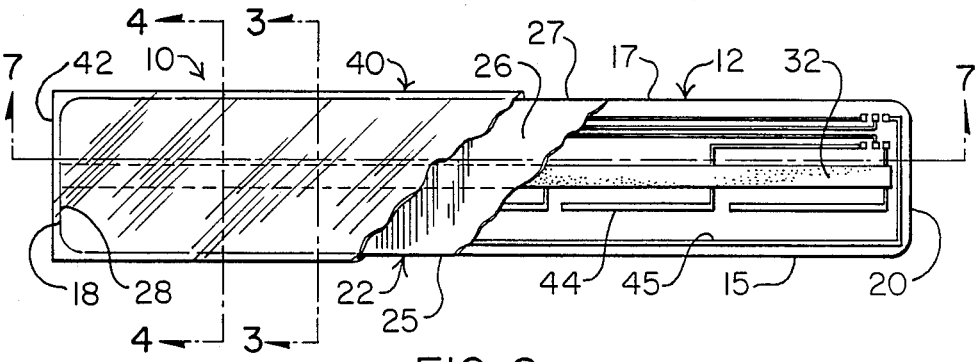
FIG. 2 is a fragmentary plan view as in FIG. 1 broken away to show the internal construction of the device.
Figure 5:
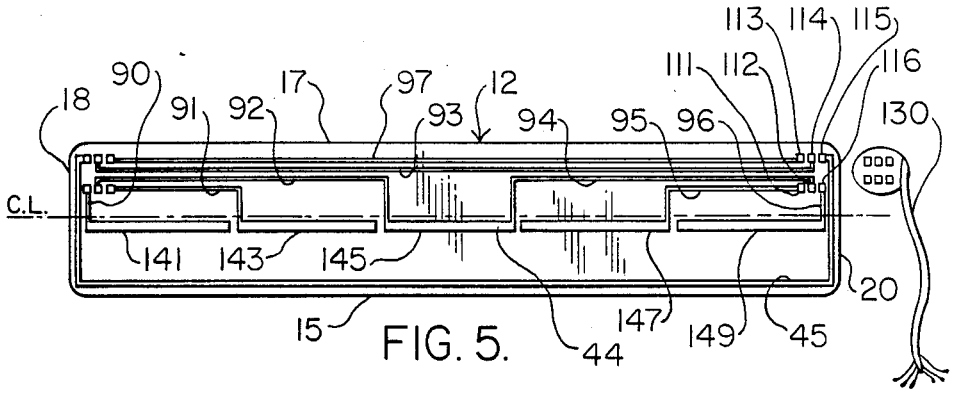
FIG. 5 is a diagrammatic representation of the arrangement of electrical sensing circuits on the upper sensing member.
Figure 6:
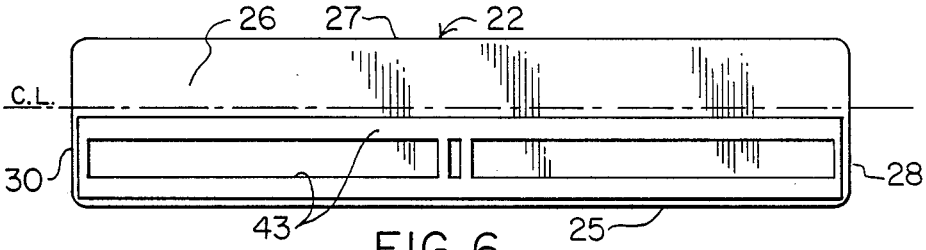
FIG. 6 is a diagrammatic representation of the electrical circuit arrangement of the lower sensing member.

The width and configuration of the conductive layers is such as to provide electrical circuits for the electrically conductive layer of approximate line widths of $\frac{1}{8}''$ to $\frac{1}{4}''$ affixed to the upper surface of the base sensing strip 12. The structure can include a plurality of circuit sets along the length of members 12, 22 for sensing and discriminating weight or forces applied at different locations along the length of the apparatus 10. For example, as shown in FIGS. 2 and 5, a set of circuits 44 divided into five equally sized cells spaced along the length of the base sensing strip and may be gathered to a convenient connector location for plugging these five circuits into appropriate wires or leads to a monitoring station or signal processing alarm (not shown). Another portion of this electrically conductive layer 45 comprises the negative pole of the circuit or a ground strip. This conductive layer 45 of approximate widths between ¼" to ½" runs continuously along the entire length of the upper surface of the base sensing strip 12. Referring to FIGS. 3, 4 and 6, another conductive layer 43 is affixed to the lower surface 24 of the contact sensing strip 22 and forms a single circuit pattern of a shape and size that when a force F is applied will be forced to contact the circuits 44, 45 of the lower member 12 and bridge its positive to its negative poles and act as a latch.

The five leads 91, 93, 95, 97 and 99 connected to each of the five contacts cells 141, 143, 145, 147, 149 are all positioned to run on the opposite side of foam strip 32 from the contacts 43, 44, 45. This configuration prevents unwanted short circuits or contacts between the leads 91, 93, 95, 97, and 99 with the contacts 43, 44, 45 in the event the apparatus 10 is extremely twisted, contorted or bent and insures that only signals from forces F as shown in FIG. 4 causes completed of closed circuit signals.

According to FIGS. 1, 2 and 3, the foam strip member 32 is applied to base member 12 along its center line by means of a self-adhesive contact surface 34 of foam member 32 being applied directly to surface 14 of base member 12. The contact member 22 is positioned over the base member 12 in a manner such that conductive circuits 44, 45 of member 12 are directly opposed to contact member 43 of member 22. This assembly is then placed into the polyethylene sleeve member 40. The two ends 42 and 46 of the polyethylene sleeve 40 are then heat sealed to form the complete enclosure and snap connectors 91 and 93 project through the sleeve end 46.

Connecting means, such as a cable 130 having six conductors, is required to connect the circuits of the sensing members to the signal processor or alarm (not shown). The conductor 115 is engaged with the said conductive layer 45 referred to as a negative or ground strip on the upper surface of the base member. The second, third, fourth, fifth and sixth conductors 111, 112, 113, 114 and 116 are engaged with the respective conductive layer circuit lines 44 and 46 which connect the five identically sized circuit cells 141, 143, 145, 147 and 149 spaced along the length of the upper surface of the base sensing strip 12 by means of conductive layer circuit lines 90, 91, 92, 93, 94, 95 and 96.

The function of the device is such that when no pressure is placed on the device conductive member 43 is not in contact with members 44, 45. However, with the weight of the patient on the device, compression of foam strip 32 is sufficient to cause the silkscreened conductive circuit surfaces 43, 44, 45 of respective ones of the five circuit cell 141, 143, 145, 147, and 149 of members 12 to contact at one place or another or at plurality of places along the length of the device and thus provide a closed circuit and an output which can be utilized a signal processor alarm (not shown).

Manufacturing in the fashion herein described, the sensor can be easily, expeditiously, and inexpensively assembled so that the device can be utilized as a disposable item, used principally for a single patient. However, because of its sealed, durable, construction, a user may elect to sanitize the device for reuse. Further, the invention can be applied to use in beds for individuals in other types of settings as well as for other types of switching purposes where pressure or distortion is to be detected.

Although the present invention has been described in terms of the preferred embodiment, it should be understood that the invention is not limited to that embodiment. Various alterations and modifications in specific shape, texture, material or manufacture, dimensions, and so forth will no doubt become apparent to those skilled in the art after having read the disclosure above. Accordingly it is intended that the following claims be interpreted as covering all alternate and modifications as fall within the scope of the invention.

The embodiments of the invention in which an exclusive property or privilege is claimed are defined as follows:

1. A first elongated flexible member and a second elongated flexible member positioned in facing relation to each other and movable toward and away from each other and movable with respect to each other longitudinally;

a first elongated electrical contact strip on the surface of said first flexible member that faces said second flexible member, and a second elongated electrical contact strip on said surface of said first flexible member that faces said second flexible member, said first and second electrical contact strips being positioned in substantially parallel, spaced-apart relation to each other on said surface of said first flexible member;

a third elongated electrical contact strip on the surface of said second flexible member that faces said first flexible member, said third elongated strip being oriented substantially parallel to said first and second contact strips and being of sufficient width and aligned in such a manner as to be able to register with and contact both said first and second contact strips simultaneously when said first and second flexible strips are moved toward each other;

compressible spacer means positioned between said first and second flexible members for holding a space between said first and second flexible members, said first and second flexible members being collapsible toward each other under the urging of an external force a sufficient distance such that said third contact strip can contact said first and second contact strips simultaneously; and elongated tubular container means encapsulating said first and second flexible members for holding said first and second flexible members in registration side to side, said first and second flexible members then being movable with respect to each other lengthwise to accomodate said holding of a space between said first and second flexible members while said first and second flexible members are formed simultaneously into arcuate and torqued configurations, and retaining the properties of said first and second flexible members, said members being positioned with said alignment and being collapsible toward each other under the urging of an external force a sufficient distance such that contact is made between the said third contact strip and the said first and second contact strips.

2. The apparatus of claim 1, wherein said elongated container means is a thin flexible plastic tube with said first and second elongated flexible members being positioned inside said tube.

3. The apparatus of claim 2, including a common electrical lead being said second contact strip extending along the length of said first flexible member to an electrical connector location, and a plurality of distinct and separate sets of said first contact strip, each respective set of which is positioned along a different portion of the length of said first flexible member, separate individual circuit electrical leads connected respectively to the individual respective sets.

4. The apparatus claim of 3, wherein said first and second flexible members are non-electrically conductive and said first, second and third electrical contact strips are uninsulated strips of electrically conductive material adhered to said surface of said first and second flexible members with said separate individual circuit electrical leads of said first contact strip positioned to one side of said foam spacer strip and said separate sets of first contact strip and said common electrical lead of said second contact strip are positioned to the opposite side of said compressible spacer means and said third contact strip is positioned to one side of the longitudinal center line of said second flexible member in a manner to provide said register with both said first and second contact strips.

5. The apparatus of claim 4, wherein said first, second and third contact strips are comprised of electrically conductive ink deposited on said respective first and second flexible members.

6. The apparatus of claim 3, wherein said third contact strip extends along a sufficient length of said second flexible member to span said plurality of contact strip sets with the width and length of said third contact strip being sufficient to make an electrical connection at any point along the length of said first flexible member between any of said respective individual sets of said first contact strip and said second common electrical contact strip when said third, first and second flexible members are forced toward each other.

* * * * *